US006173708B1

(12) United States Patent
Arntz et al.

(10) Patent No.: US 6,173,708 B1
(45) Date of Patent: Jan. 16, 2001

(54) GAS BURNER MOUNTING ASSEMBLY FOR APPLIANCE WITH CERAMIC BASED COOKTOP

(75) Inventors: Timothy John Arntz; Steven Todd Brooks; Mark A. Pickering, all of Cleveland, TN (US)

(73) Assignee: Maytag Corporation, Newton, IA (US)

( * ) Notice: Under 35 U.S.C. 154(b), the term of this patent shall be extended for 0 days.

(21) Appl. No.: 09/439,991

(22) Filed: Nov. 15, 1999

(51) Int. Cl.[7] ..... F24C 3/00
(52) U.S. Cl. ..... 126/39 R; 126/39 H
(58) Field of Search ..... 126/39 R, 39 H, 126/39 N, 39 J, 39 K

(56) References Cited

U.S. PATENT DOCUMENTS

| | | | |
|---|---|---|---|
| 5,024,209 | | 6/1991 | Shaupert . |
| 5,040,970 | | 8/1991 | Riehl . |
| 5,046,477 | | 9/1991 | Bennett et al. . |
| 5,083,915 | | 1/1992 | Riehl . |
| 5,085,202 | | 2/1992 | Riehl . |
| 5,125,390 | | 6/1992 | Riehl . |
| 5,133,334 | | 7/1992 | Riehl . |
| 5,139,417 | | 8/1992 | Ghassemzadeh . |
| 5,149,262 | | 9/1992 | Riehl . |
| 5,152,276 | | 10/1992 | Brock et al. . |
| 5,313,929 | | 5/1994 | Thurk et al. . |
| 5,325,842 | | 7/1994 | Beach et al. . |
| 5,628,302 | | 5/1997 | Schatz et al. . |
| 5,653,219 | | 8/1997 | Taplan et al. . |
| 6,032,662 | * | 3/2000 | Taplan et al. ..... 126/39 H |

* cited by examiner

*Primary Examiner*—Ira S. Lazarus
*Assistant Examiner*—David Lee
(74) *Attorney, Agent, or Firm*—Everett G. Diederiks, Jr

(57) ABSTRACT

A gas burner mounting assembly includes a gas injector having a main body portion positioned between a chassis member of a gas cooking appliance and a ceramic based cooktop of the appliance. The gas injector also includes an upper body portion which extends through an aperture formed in the cooktop. A burner retention bracket is interposed between the main body portion of the gas injector and an underside of the cooktop. A resilient support preferably acts between the gas injector and the cooktop, although no rigid attachment is made between these elements. The gas injector is mechanically, fixedly secured to the cooktop in order to allow the gas injector to flex with the cooktop.

27 Claims, 2 Drawing Sheets

GAS BURNER MOUNTING ASSEMBLY FOR APPLIANCE WITH CERAMIC BASED COOKTOP

BACKGROUND OF THE INVENTION

1. Field of the Invention

The present invention pertains to the art of gas cooking appliances and, more particularly, to the mounting of a gas burner to a ceramic based appliance cooktop.

2. Discussion of the Prior Art

A conventional gas cooking appliance will incorporate a cooktop which is generally formed of coated metal or glass. The cooktop is provided with an opening for receiving a gas operated burner. More specifically, the gas burner projects through the cooktop and is typically, rigidly secured to a chassis of the appliance and either fixedly or loosely secured to the cooktop. Whether a rigid or loose connection is present, some type of sealing arrangement is often provided between the cooktop and the gas burner in order to seal the opening so as to enhance the cleanability of the overall appliance.

Other known gas appliances incorporate ceramic based cooktops, e.g., ceramic and glass-ceramic cooktops. Due to material characteristic limitations, the interior panel of such a ceramic based cooktop must be free to flex during use of the appliance. For at least this reason, either a loose connection or no connection at all is generally provided between a gas burner and a ceramic based cooktop, while a rigid connection is utilized between the gas burner and the appliance chassis. With such an arrangement, since the gas burner must still project through an opening in the cooktop, it is extremely difficult to provide an extremely effective seal around the burner unit.

Although some attempts have been made in the art to provide an arrangement wherein a gas burner is secured against a ceramic based cooktop, there exists a need in the art for an enhanced gas burner mounting assembly for use in connection with a cooking appliance incorporating a ceramic based cooktop, wherein the gas burner is fixedly secured to the cooktop in a manner which enables the burner to flex with the cooktop during use.

SUMMARY OF THE INVENTION

The present invention is directed to a gas burner mounting assembly in a cooking appliance including a ceramic based cooktop, wherein a gas burner is fixedly secured to the cooktop and, preferably, loosely connected to a chassis of the appliance. With this arrangement, the gas burner can flex with the ceramic cooktop during operation of the cooking appliance.

In accordance with the most preferred form of the invention, the gas burner mounting assembly includes a gas injector/mixer having a main body portion arranged below the cooktop and an upper body portion which extends through a mounting aperture formed in the cooktop. A burner retention bracket is preferably placed about the upper body portion so as to be interposed between the main body portion and the underside of the cooktop. In addition, a first gasket is arranged between the burner retention bracket and the underside of the cooktop.

At least a section of the upper body portion of the gas injector/mixer which extends through the cooktop is externally threaded and projects into a central through hole formed in a gas burner head positioned on the cooktop, preferably with a second gasket interposed between the gas burner head and the cooktop. A fastening member, which preferably takes the form of a nut, is threaded on the upper body portion of the gas injector/mixer, thereby fixedly securing the gas injector/mixer, the burner retention bracket, the first and second gaskets and the gas burner head to the cooktop. The overall gas burner mounting assembly further includes a burner cap which is set on top of the burner head.

Given the rigid connection between the gas burner and the ceramic based cooktop, when the cooktop flexes during use of the cooking appliance, the gas burner will also flex. In order to provide a resilient support at various spaced locations for the cooktop, it is also preferable in accordance with the present invention to provide a resilient support which acts between a chassis member of the cooking appliance and each of the gas burners. In accordance with a first embodiment of the invention, a resilient mounting support is positioned between the chassis member and the gas injector/mixer in order to bias the gas injector/mixer towards the cooktop. In another embodiment, a gas supply line extending to the gas injector/mixer is supported by the appliance chassis at a position spaced from the gas injector/mixer such that the gas supply line essentially acts as a leaf spring. In either case, a resilient support is provided for the cooktop, while also biasing the gas injector towards the underside of the cooktop. Regardless of the presence or particular type of biasing arrangement utilized, no rigid connection is provided between the gas burner and the chassis in order to ensure the ability of the gas burner to flex with the cooktop.

Additional objects, features and advantages of the present invention will become more readily apparent from the following detailed description of the preferred embodiment when taken in conjunction with the drawings wherein like reference numerals refer to corresponding parts in the several views.

DETAILED DESCRIPTION OF THE PREFERRED EMBODIMENT

Figure 1:
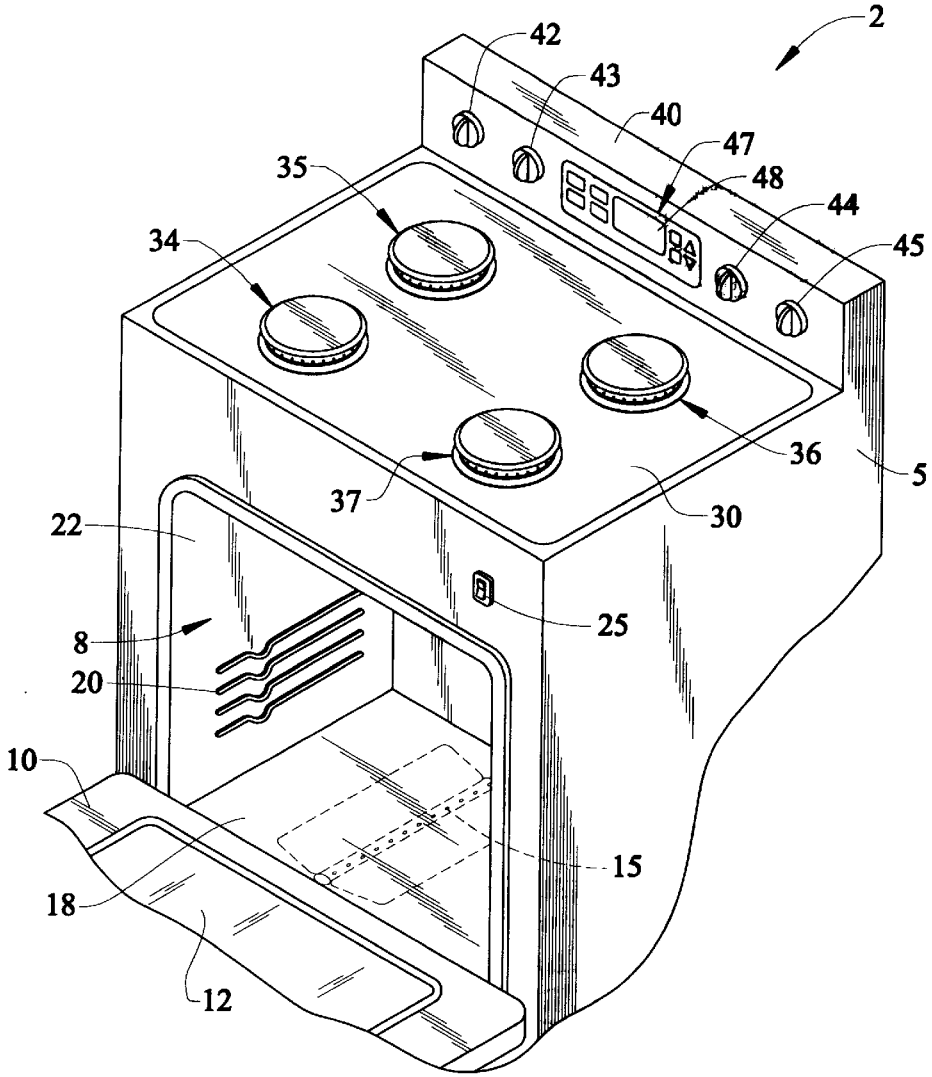
FIG. 1 is a partial perspective view of a range incorporating the gas burner mounting assembly of the present invention.

With initial reference to FIG. 1, the present invention is incorporated in a cooking appliance 2 which is shown to constitute a typical domestic range. At this point, it should be realized that the present invention could also be used in connection with an island-type cooktop. In any event, for exemplary purposes, cooking appliance 2 is shown to include a cabinet 5 within which is formed an oven cavity 8. Oven cavity 8 has associated therewith a door 10 which is provided with a tempered glass viewing panel 12. Cooking appliance 2 operates on gas and therefore a gas burner 15 is provided beneath a bottom 18 of oven cavity 8. Furthermore, a plurality of fore-to-aft extending and vertically spaced rails 20 are provided upon opposing side walls, one of which is indicated at 22, for supporting one or more vertically adjustable racks (not shown) within oven cavity 8. For the sake of completeness, cooking appliance 2 is shown to be provided with a switch 25 that is adapted to be engaged by door 10 in order to de-activate a light (not shown) used to illuminate oven cavity 8 upon opening of door 10. As should be readily apparent, the structure of cooking appliance 2 described to this point is widely known in the art and does not form part of the present invention. Instead, this basic structure is simply provided for the sake of completeness.

In accordance with the invention, cooking appliance 2 incorporates a ceramic based-type cooktop 30. That is, cooktop 30 can take various forms and can be made from various ceramic based materials. Therefore, by referring to the cooktop 30 as being made from a ceramic-based material, it is intended to cover various materials including ceramic, glass-ceramic and like materials. Mounted to cooktop 30 are a plurality of gas burner assemblies 34–37. Arranged at an upper rear portion of cooking appliance 2 is a control panel 40 that is preferably provided with a plurality of knobs 42–45 for controlling the operation of gas burners 34–37 respectively. In addition, control panel 40 is shown to include a central control unit 47 that includes a visual display 48. Central control unit 47 is actually used to establish desired cooking operations for oven cavity 8. Since the arrangement and operation of central control unit 47 does not form part of the present invention, it will not be discussed further here.

Figure 3:
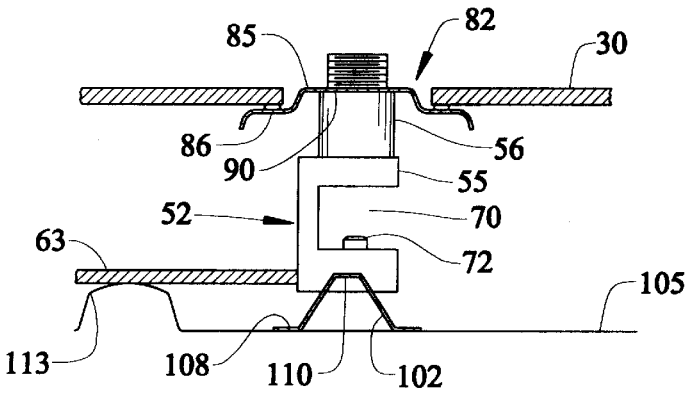
FIG. 3 is an elevational view of a portion of the gas burner mounting assembly shown in an assembled condition.
Figure 2:
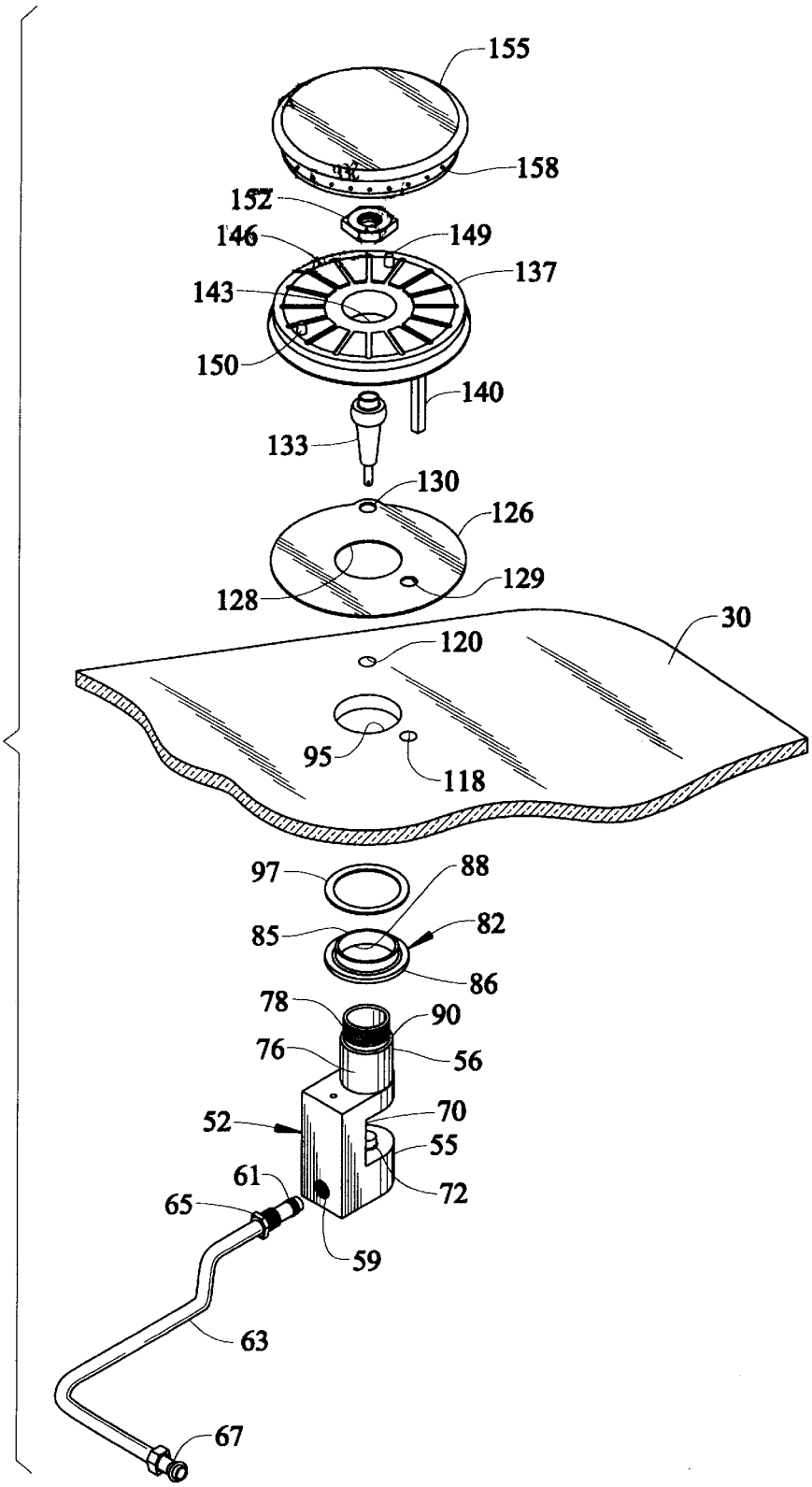
FIG. 2 is an exploded view of the gas burner mounting assembly of the invention.

Reference will now be made to FIGS. 2 and 3 in describing the preferred structure and mounting of gas burner assembly 34 in accordance with the invention and it is to be understood that gas burner assemblies 35–37 are correspondingly arranged. As shown, gas burner mounting assembly 34 includes a gas injector 52 which essentially functions as both an injector and a mixer as will be described more fully below. As shown, gas injector 52 includes a main body portion 55 and an upper body portion 56. The main body portion 55 is provided with a threaded port 59 to which is attached a first end 61 of a gas line 63 through the use of a threaded fitting 65. Gas line 63 also includes a second end 67 which is adapted to be attached to additional gas piping (not shown). Main body portion 55 includes a cut-out central zone 70 into which projects a gas discharge nozzle 72. Nozzle 72 is fluidly connected to threaded port 59 such that gas flowing to gas injector 52 through line 63 will be discharged through nozzle 72. The gas discharged through nozzle 72 is directed to upper body portion 56 of gas injector 52. Upper body portion 56 includes a first tubular section 76 and a second tubular section 78. As shown, second tubular section 78 is preferably, externally threaded.

Gas burner mounting assembly 34 further includes a burner retention bracket 82 which, in a preferred embodiment, is formed with a first diametric portion 85 and a second, enlarged diametric portion 86. The first diametric portion 85 is provided with a central through hole 88 that is adapted to extend about second tubular section 78 of upper body portion 56 and to rest upon a ledge 90 defined between the first tubular section 76 and the second tubular section 78.

Cooktop 30 is provided with a mounting aperture 95 into which extends second tubular section 78 of gas injector 52. In accordance with the most preferred form of the invention, second diametric portion 86 of burner retention bracket 82 is located in a lower plane than first diametric portion 85 such that first diametric portion 85 also extends into mounting aperture 95 as clearly illustrated in FIG. 3. Therefore, mounting aperture 95 has a larger associated diameter than first diametric portion 85, while second diametric portion 86 of burner retention bracket 82 is arranged below cooktop 30. Actually, as will be described more fully below, the second diametric portion 86 of burner retention bracket 82 is arranged against the underside of cooktop 30 with an annular gasket 97, preferably made of silicon, positioned therebetween.

FIG. 3 illustrates two preferred embodiments for biasing gas injector 52 towards cooktop 30. More specifically, FIG. 3 illustrates the presence of a resilient mounting support 102 which extends between a chassis panel member 105 and main body portion 55 of gas injector 52. As shown, resilient mounting support 102 includes an annular support leg 108 which abuts chassis member 105 and a frusto-conical top portion 110 which extends into a recessed area (not separately labeled) of main body portion 55. Due to the presence of resilient mounting support 102 between chassis member 105 and gas injector 52, gas injector 52 is biased towards the underside of cooktop 30. As an alternative biasing arrangement, or an arrangement which can be used in combination with resilient mounting support 102, chassis member 105 is shown to be formed with a raised portion 113 which is abutted by a portion of gas line 63 at a positioned spaced from gas injector 52. With this arrangement, gas line 63 can essentially act as a leaf spring to also bias gas injector 52 towards cooktop 30.

As best shown in FIG. 2, cooktop 30 also includes a through hole 118 and a bore 120 which are spaced from each other and offset from mounting aperture 95. An upper gasket 126, having a central hole 128 and a pair of offset holes 129 and 130, is adapted to be positioned atop cooktop 30 with central hole 128 aligning with mounting aperture 95, offset hole 129 aligning with through hole 118 and offset hole 130 aligning with bore 120. When upper gasket 126 is positioned against cooktop 30, the second tubular section 78 of upper body portion 56 projects through central hole 128.

An electronic igniter 133 is adapted to extend through offset hole 130 and bore 120. Although not shown, electronic igniter 133 would be connected to an electric wire below cooktop 30 and is used to create a spark for igniting gas burner assembly 34. Gas burner assembly 34 also includes a gas burner head 137 that is preferably formed with a depending locating pin 140. Locating pin 140 is adapted to be aligned with offset hole 129 and through hole 118 in order that gas burner head 137 can rest against cooktop 30 with upper gasket 126 interposed therebetween. Gas burner head 137 also includes a central hole 143 through which upper body portion 56 of gas injector 52 projects. In the manner known in the art, gas burner head 137 is provided with a plurality of spaced, radial gas/air guiding grooves 146. Furthermore, gas burner head 137 is shown to include a pair of upstanding projections 149 and 150.

In order to rigidly secure gas injector 52 to a cooktop 30, gas burner assembly 34 also includes a fastening member 152 which takes the form of a nut. Fastening member 152 is preferably threadably engaged with second tubular section 78 of gas injector 52 and is tightened in order to draw gas burner head 137 and gas injector 52 together, thereby sandwiching cooktop 30 between second diametric portion 86 of burner retention bracket 82 and gas burner head 137. Once fastening member 152 is tightened, gas injector 52 is rigidly, fixedly secured to cooktop 30. Gas burner assembly 34 further includes a burner cap 155 which is adapted to sit atop gas burner head 137. Burner cap 155 includes a plurality of circumferentially spaced and radially opening ports 158, each of which is adapted to be aligned with a respective radial groove 146. Upstanding projections 149 and 150 on gas burner head 137 and recesses (not shown) formed in burner cap 155 provide for the proper alignment. Electronic ignitor 133 is positioned adjacent at least one of ports 158.

With this construction, it should be readily apparent that gas injector 52 will flex with cooktop 30 during operation of cooking appliance 2. In addition, the inclusion of resilient mounting support 102 and/or the supporting of gas line 63 on raised portion 113 of chassis member 105 provides additional support for cooktop 30, while also aiding in maintaining gas injector 52 in a proper position as shown in FIG. 3 while upper gasket 26, electronic igniter 133, gas burner head 137 and fastening member 152 are assembled in the manner described above. In any event, gas injector 52 is loosely connected to chassis member 105 either through the resilient mounting support 102 or gas line 63.

It should be noted that burner retention bracket 82 performs various functions. First of all, burner retention bracket 82 locates the threads of second tubular section 78 at the proper distance above cooktop 30 in order to enable second tubular section 78 to project through central through hole 143 in gas burner head 137 and to be engaged by fastening member 152. In addition, burner retention bracket 82 functions as a stop on the underside of cooktop 30 due to the indirect engagement between second diametric portion 86 and the underside of cooktop 30. Gaskets 97 and 126 protect cooktop 30 from direct abutment with burner retention bracket 82 and both electric igniter 133 and gas burner head 137 respectively. In the most preferred form of the invention, both burner retention bracket 82 and gas burner head 137 are preferably made of metal. In addition, gaskets 97 and 126 provide a sealing function for the overall mounting of gas burner assembly 34.

Although described with respect to preferred embodiments of the invention, it should be readily apparent that various changes and/or modifications can be made to the invention without departing from the spirit thereof. For example, instead of providing projections 149, 150 and fastening member 152, a fastener member could be integrated into burner cap 155 which would be threaded onto second tubular section 78 and tightened to still align ports 158 of burner cap 155 with grooves 146. In general, the invention is only intended to be limited by the scope of the following claims.

We claim:

1. In a gas cooking appliance including a ceramic based cooktop spaced above a chassis member of the appliance and provided with a mounting aperture, a gas burner mounting assembly comprising:

a gas injector having a main body portion, positioned between the chassis member and the cooktop, and an upper body portion extending into the mounting aperture of the cooktop, said upper body portion being threaded; and a fastening member arranged above the cooktop, said fastening member being threadably attached to the upper body portion of said gas injector to fixedly secure the gas injector to the cooktop, with the cooktop being positioned between the main body portion of the gas injector and the fastening member.

2. The gas burner mounting assembly according to claim 1, wherein the upper body portion of the gas injector is externally threaded.

3. The gas burner mounting assembly according to claim 1, further comprising: a burner retention bracket interposed between the main body portion and an underside of the cooktop.

4. The gas burner mounting assembly according to claim 3, wherein the burner retention bracket includes a first diametric portion and a second, larger diametric portion, with said first diametric portion projecting into the mounting aperture and the second diametric portion extending below the cooktop.

5. The gas burner mounting assembly according to claim 4, further comprising: a gasket interposed between the second diametric portion and the underside of the cooktop.

6. The gas burner mounting assembly according to claim 1, wherein the main body portion of the gas injector is spaced above the chassis member.

7. The gas burner mounting assembly according to claim 6, further comprising: means, acting between the chassis member and the main body portion of the gas injector, for biasing the gas injector towards the cooktop.

8. The gas burner mounting assembly according to claim 7, wherein the biasing means comprises a resilient mounting support interposed between the chassis member and the gas injector.

9. The gas burner mounting assembly according to claim 7, wherein the biasing means includes a gas supply line which is attached to the gas injector and abuts the chassis member.

10. The gas burner mounting assembly according to claim 1, further comprising: a gas burner head positioned atop the cooktop between the cooktop and the fastening member.

11. The gas burner mounting assembly according to claim 10, further comprising: a through hole formed in the cooktop at a position offset from the mounting aperture, and a locator pin depending from the gas burner head, said locator pin extending into the through hole.

12. The gas burner mounting assembly according to claim 11, further comprising: a bore formed in the cooktop at a position offset from each of the mounting aperture and the through hole, and an electronic igniter element projecting into the bore.

13. The gas burner mounting assembly according to claim 12, further comprising: a gasket positioned between the cooktop and the gas burner head, said gasket including three openings respectively aligned with the mounting aperture, the through hole and the bore in said cooktop.

14. The gas burner mounting assembly according to claim 12, further comprising: a burner cap positioned atop the gas burner head, said burner cap being formed with a plurality of circumferentially spaced and radially opening burner ports, said electronic igniter being positioned adjacent at least one of said burner ports.

15. In a gas cooking appliance including a ceramic based cooktop spaced above a chassis member of the appliance and provided with a mounting aperture, a gas burner mounting assembly comprising:

a gas injector having a main body portion, positioned between the chassis member and the cooktop, and an upper body portion extending into the mounting aperture of the cooktop, said gas injector being rigidly secured to the cooktop; and means, acting between the chassis member and the main body portion of the gas injector, for biasing the gas injector towards the cooktop while permitting the gas injector to shift relative to the chassis member.

16. The gas burner mounting assembly according to claim 15, wherein the biasing means comprises a resilient mounting support interposed between the chassis member and the gas injector.

17. The gas burner mounting assembly according to claim 15, wherein the biasing means includes a gas supply line which is attached to the gas injector and abuts the chassis member.

18. The gas burner mounting assembly according to claim 15, wherein said upper body portion of the gas injector is threaded and said gas burner mounting assembly further comprises a fastening member arranged above the cooktop, said fastening member being threadably attached to the upper body portion of said gas injector to fixedly secure the gas injector to the cooktop, with the cooktop being positioned between the main body portion of the gas injector and the fastening member.

19. The gas cooking appliance according to claim 18, wherein the upper body portion of the gas injector is externally threaded.

20. The gas burner mounting assembly according to claim 15, further comprising: a burner retention bracket interposed between the main body portion and an underside of the cooktop.

21. The gas burner mounting assembly according to claim 20, wherein the burner retention bracket includes a first diametric portion and a second, larger diametric portion, with said first diametric portion projecting into the mounting aperture and the second diametric portion extending below the cooktop.

22. The gas burner mounting assembly according to claim 21, further comprising: a gasket interposed between the second diametric portion and the underside of the cooktop.

23. The gas burner mounting assembly according to claim 15, further comprising: a gas burner head positioned atop the cooktop at the upper body portion of the gas injector.

24. The gas burner mounting assembly according to claim 23, further comprising: a through hole formed in the cooktop at a position offset from the mounting aperture, and a locator pin depending from the gas burner head, said locator pin extending into the through hole.

25. The gas burner mounting assembly according to claim 24, further comprising: a bore formed in the cooktop at a position offset from each of the mounting aperture and the through hole, and an electronic igniter element projecting into the bore.

26. The gas burner mounting assembly according to claim 25, further comprising: a gasket positioned between the cooktop and the gas burner head, said gasket including three openings respectively aligned with the mounting aperture, the through hole and the bore in said cooktop.

27. The gas burner mounting assembly according to claim 25, further comprising: a burner cap positioned atop the gas burner head, said burner cap being formed with a plurality of circumferentially spaced and radially opening burner ports, said electronic igniter being positioned adjacent at least one of said burner ports.

* * * * *